US009058718B2

(12) United States Patent
Okada et al.

(10) Patent No.: US 9,058,718 B2
(45) Date of Patent: Jun. 16, 2015

(54) GAMING MACHINE AND GAMING METHOD OF PERFORMING RENDERING EFFECT

(71) Applicants: Universal Entertainment Corporation, Tokyo (JP); Aruze Gaming America, Inc., Las Vegas, NV (US)

(72) Inventors: Kazuo Okada, Tokyo (JP); Masumi Fujisawa, Tokyo (JP); Kenta Kitamura, Tokyo (JP); Susumu Mio, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 0 days.

(21) Appl. No.: 13/741,488

(22) Filed: Jan. 15, 2013

(65) Prior Publication Data

US 2014/0200064 A1 Jul. 17, 2014

(51) Int. Cl.

*G06F 17/00* (2006.01)
*G06F 19/00* (2011.01)
*G07F 17/32* (2006.01)

(52) U.S. Cl.

CPC ..... *G07F 17/3213* (2013.01); *G07F 17/3288* (2013.01)

(58) Field of Classification Search

CPC . G07F 17/32; G07F 17/3211; G07F 17/3213; G07F 17/3227; G07F 17/3244; G07F 17/3262; G07F 17/3269; G07F 17/3288; G07F 17/34

USPC ..... 463/16–20, 25, 29–33, 40–43; 273/143 R

See application file for complete search history.

(56) References Cited

U.S. PATENT DOCUMENTS

| | | | | |
|---|---|---|---|---|
| 6,254,483 | B1 * | 7/2001 | Acres | 463/26 |
| 8,657,671 | B2 * | 2/2014 | Ansari et al. | 463/25 |
| 8,696,436 | B2 * | 4/2014 | Acres | 463/20 |
| 8,821,244 | B1 * | 9/2014 | Detlefsen et al. | 463/16 |
| 2003/0003988 | A1 * | 1/2003 | Walker et al. | 463/21 |
| 2004/0127284 | A1 * | 7/2004 | Walker et al. | 463/30 |
| 2006/0148553 | A1 * | 7/2006 | Dodge | 463/20 |
| 2007/0060323 | A1 * | 3/2007 | Isaac et al. | 463/29 |
| 2007/0178959 | A1 * | 8/2007 | Halprin | 463/20 |
| 2007/0218970 | A1 * | 9/2007 | Patel et al. | 463/16 |
| 2008/0058067 | A1 | 3/2008 | Okada | |
| 2008/0058072 | A1 | 3/2008 | Okada | |
| 2008/0096633 | A1 * | 4/2008 | Power | 463/20 |
| 2008/0132312 | A1 * | 6/2008 | Yoshizawa | 463/16 |
| 2008/0146318 | A1 * | 6/2008 | Durham et al. | 463/20 |
| 2010/0056248 | A1 * | 3/2010 | Acres | 463/20 |
| 2012/0295689 | A1 * | 11/2012 | Owen et al. | 463/20 |

* cited by examiner

*Primary Examiner* — Milap Shah

(74) *Attorney, Agent, or Firm* — Lexyoume IP Meister, PLLC

(57) ABSTRACT

A gaming machine according to an embodiment of the present invention includes: a first display unit that includes a plurality of reels including a plurality of symbols thereon; and a controller configured to: determine whether a rendering effect activation is selected; execute a game by spinning and stopping the plurality of reels of the display device; and perform a rendering effect on the spinning and stopping of the plurality of reels when it is determined that the rendering effect activation is selected.

14 Claims, 17 Drawing Sheets

FIG. 3

| Name | Symbol |
|---|---|
| DJP | DOUBLE S JACKPOT |
| WILD | WILD |
| RED7 | 7 |
| CHERRY | |
| 3BAR | BAR BAR BAR |
| 2BAR | BAR BAR |
| 1BAR | BAR |

GAMING MACHINE AND GAMING METHOD OF PERFORMING RENDERING EFFECT

BACKGROUND (a) Field

The present invention generally relates to a gaming machine and a gaming method.

(b) Description of the Related Art

A conventional gaming machine includes a display arranged with a plurality of symbols. The gaming machine rearranges the symbols in a unit game, and awards a payout to a player according to the combination of rearranged symbols (for example, United State Patent Application Publication No. 2008/0058067 and United State Patent Application Publication No. 2008/0058072). The player can start another unit game after one unit game ends.

However, in the conventional gaming machine, although the unit games are repeatedly executed, there is continuity of the unit games. Since the conventional gaming machine does not provide the continuity of the unit games, it is difficult to attract a player's interest in a game.

SUMMARY

A gaming machine according to an embodiment of the present invention includes: a first display unit that includes a plurality of reels including a plurality of symbols thereon; and a controller configured to: determine whether a rendering effect activation is selected; execute a game by spinning and stopping the plurality of reels of the display device; and perform a rendering effect on the spinning and stopping of the plurality of reels when it is determined that the rendering effect activation is selected.

The gaming machine may further include an input unit configured to be operable with an administration key to have a setting screen displayed, the rendering effect activation being selected through the setting screen.

The game may be neither being executed nor ready to be executed when the setting screen is displayed.

The administration key comprises at least one of a physical key and a soft key.

The controller may be further configured to: determine a symbol arrangement of the game; select one of a plurality of rendering patterns based on the determined symbol arrangement when it is determined that the rendering effect activation is selected; spin and stop the plurality of reels based on the selected one of the plurality of rendering patterns; and perform a payout based on the determined symbol arrangement.

The controller may be further configured to: execute the game by spinning and stopping the plurality of reels of the display device without the rendering effect when it is determined that the rendering effect activation is not selected.

A duration of the execution of the game with the rendering effect may be longer than a duration the execution of the game without the rendering effect.

The rendering effect may include at least one of rendering movement of the plurality of symbols, visual effect, and sound effect.

The rendering movement may include a long spin action.

A gaming method according to an embodiment of the present invention includes: displaying a setting screen of a rendering effect activation to be selected; determining whether the rendering effect activation is selected; and execute a game by spinning and stopping a plurality of reels, wherein a rendering effect is performed on the spinning and stopping of the plurality of reels when it is determined that the rendering effect activation is selected.

The setting screen may be displayed by an administration key.

The administration key may include at least one of a physical key and a soft key.

The game may be neither being executed nor ready to be executed when the setting screen is displayed.

The executing a game includes: determining a symbol arrangement of the game when a signal informing of a start of a game is received from a player input unit; selecting one of a plurality of rendering patterns based on the determined symbol arrangement when it is determined that the rendering effect activation is selected; spinning and stopping the plurality of reels based on the selected one of the plurality of rendering patterns; and performing a payout based on the determined symbol arrangement.

No rendering effect may be performed when it is determined that the rendering effect activation is not selected.

A duration of the execution of the game with the rendering effect may be longer than a duration the execution of the game without the rendering effect.

The rendering effect may include at least one of rendering movement of the plurality of symbols, visual effect, and sound effect.

The rendering movement may include a long spin action.

BRIEF DESCRIPTION OF THE DRAWINGS

FIG. 3 illustrates symbols used in a game according an embodiment of the present invention.

DETAILED DESCRIPTION

Figure 1:
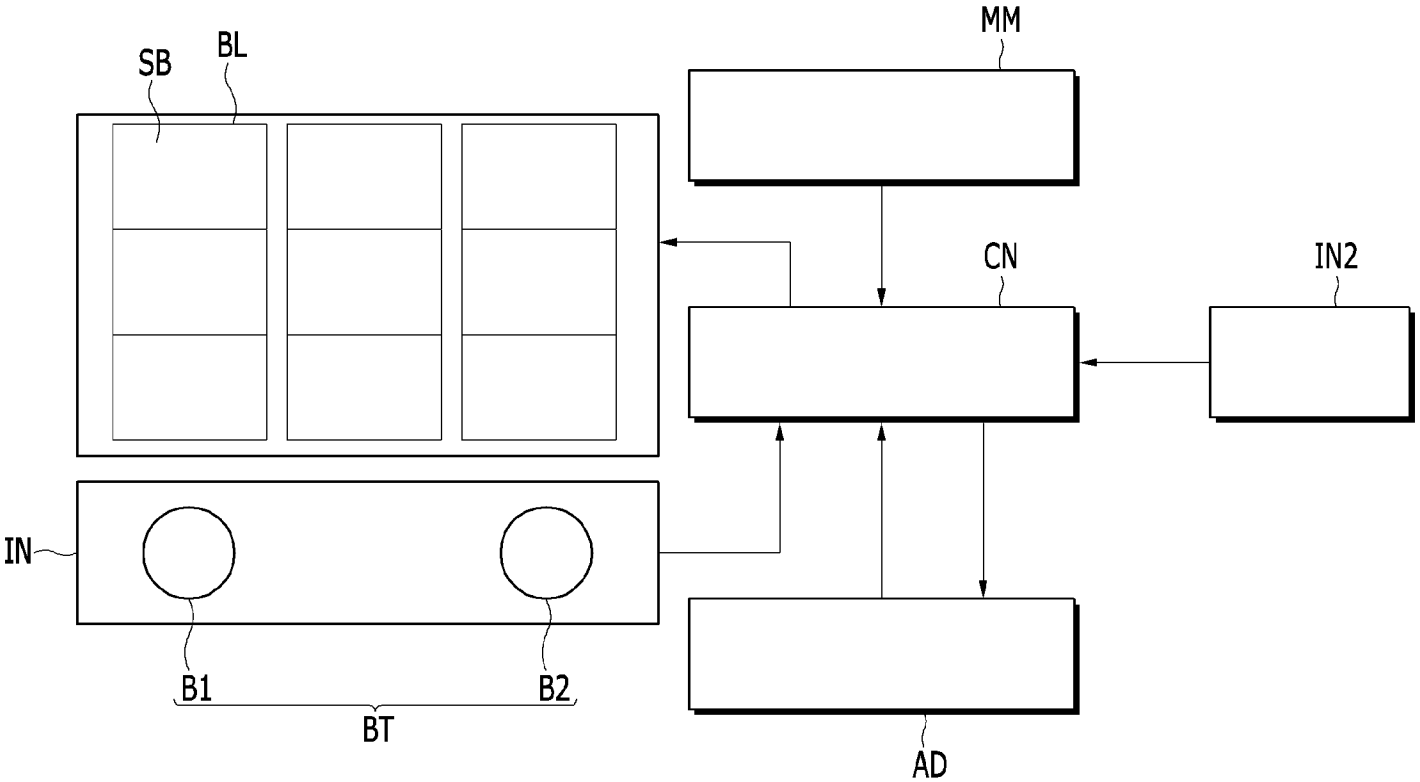
FIG. 1 is a schematic block diagram of a gaming machine according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Outline of Gaming Machine and Gaming Method

A gaming machine according to an embodiment of the present invention is described with reference to FIG. 1 to FIG. 7.

Figure 2:
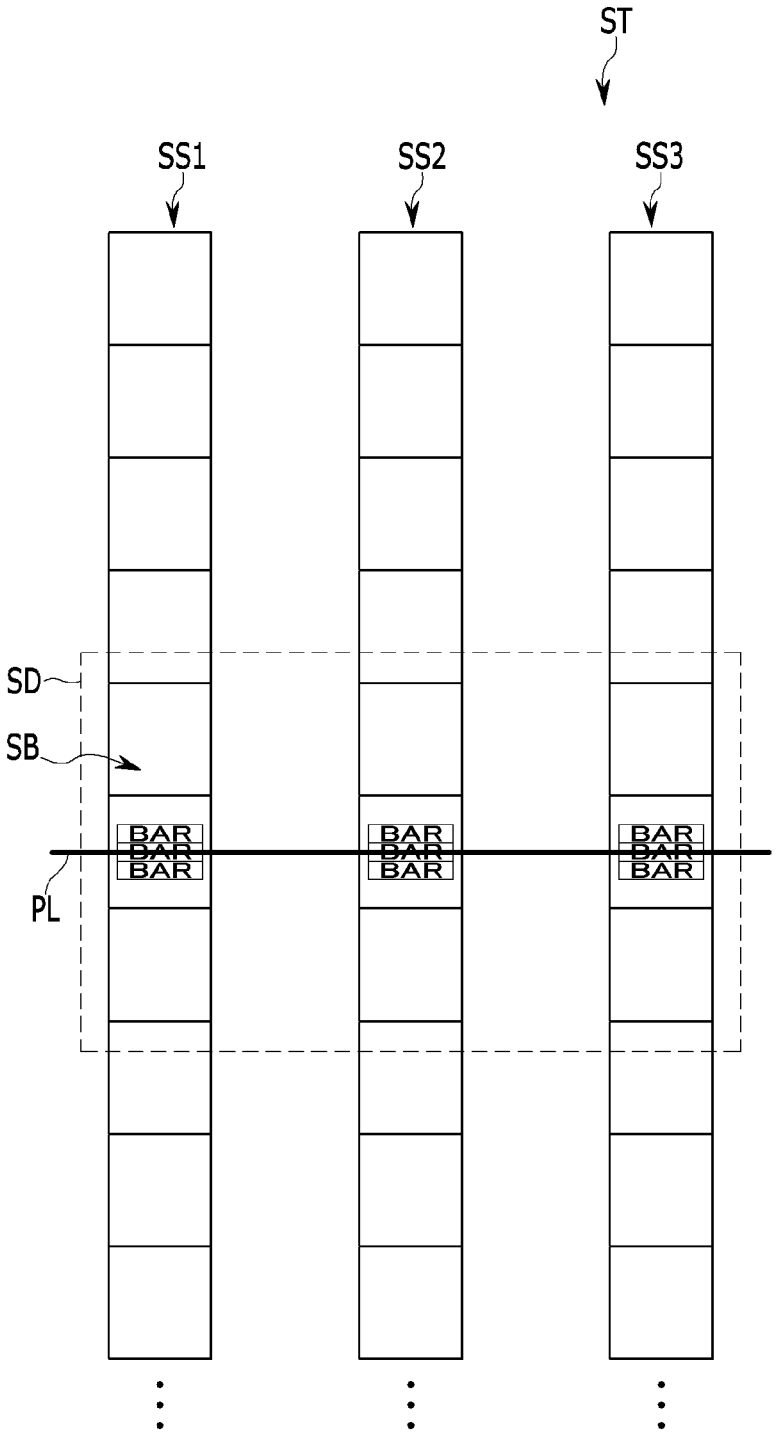
FIG. 2 is a schematic view of symbol strips in a gaming machine according to an embodiment of the present invention.

FIG. 1 is a schematic block diagram of a gaming machine according to an embodiment of the present invention, FIG. 2 is a schematic view of symbol strips in a gaming machine according to an embodiment of the present invention, FIG. 3 illustrates symbols used in a game according an embodiment of the present invention, and FIG. 4 to FIG. 7 are exemplary audit screens according an embodiment of the present invention.

Referring to FIG. 1, a gaming machine 1 according to an embodiment of the present invention includes a symbol display SD, a player input unit IN1, an auxiliary display AD, an administrator input unit IN2, a memory MM, and a controller CN connected to the symbol display SD, the player input unit IN1, and an audit display AD. The gaming machine 1 may execute a game.

The symbol display SD displays a set of symbols SB for the game, in a moving state or in a stop state. Referring to FIG. 2, the symbols SB in a symbol set ST may be disposed on a plurality of reels that may be actual/mechanical reels or virtual/video reels, and each reel carries a series of the symbols SB forming a symbol strip SS1-SS3. Each symbol strip SS1-SS3 starts to move, spin, or scroll, and then stops the movement in an execution (or a round) of the game. The movement of the symbol strip SS1-SS3 may be performed with or without rendering effects. The rendering effects may include rendering movements of the symbols SB, sound effects, and visual effects, for example, and may be performed to inform of a win or a big win to a player. The rendering movements may include variation of moving speeds and moving directions. Detailed examples of the rendering effects will be described later.

A predetermined number of consecutive symbols in each symbol strip SS1-SS3 can be displayed on the symbol display SD in the stop state while remaining symbols are not shown on the symbol display SD. The symbols SB shown on the symbol display SD in the stop state occupy respective display blocks BL of the symbol display SD arranged in rows and columns and form "a symbol arrangement." According to an embodiment of the present invention, a set of symbols SB includes three symbol strips SS1-SS3, and three symbols selected from each of the three symbol strips SS1-SS3, that is, a total of nine symbols form a symbol arrangement in a shape of a 3×3 matrix.

FIG. 2 shows an exemplary payline PL that passes through a row in each column of a symbol arrangement. When a group of the symbols SB in the symbol arrangement placed on the payline PL satisfies a predetermined condition, a player may win the game. For example, when two or three symbols SB successively arranged from a first symbol strip SS1 to right along the payline PL are the same, the gaming machine 1 may award a prize to the player. Such a combination of the symbols SB that provides a win is referred to as a "winning combination." According to an embodiment of the present invention, only one payline PL shown in FIG. 2 may be adapted. However, various paylines may be drawn, and two or more of the paylines may be selected by the player to expect more probability of win.

In addition to a win with the payline PL (referred to as a "line win"), there may be another type of win referred to as a "scatter win" that is given when one or more of predetermined symbols are shown on the symbol display SD although they are scattered.

The symbols SB may include ordinary symbols and special symbols including wild symbols, scatter symbols, and function symbols, for example. A wild symbol on a payline can substitute for any other symbol except for a function symbol to create a winning combination. The scatter symbols may form a scatter win. The function symbols may include double symbols, and a double symbol on a payline may double a win prize for the payline.

FIG. 3 shows various exemplary symbols according to an embodiment. The symbols SB may include a double jackpot symbol denoted by "DJP," a wild symbol denoted by "WILD," a seven symbol denoted by "RED7," a cherry symbol denoted by "CHERRY," a three-bar symbol denoted by "3BAR," a two-bar symbol denoted by "2BAR," and a one-bar symbol denoted by "1BAR."

According to an embodiment of the present invention, only a payline PL shown in FIG. 2 is adapted.

According to an embodiment of the present invention, a double jackpot symbol DJP on a payline may double a win prize for the payline, and two double jackpot symbols DJP on a payline may quadruple a win prize for the payline. According to an embodiment of the present invention, a double jackpot symbol DJP on a payline may be substituted with any other symbol, and a wild symbol WILD on a payline can substitute for any other symbol except for a double jackpot symbol DJP.

Referring to FIG. 1 again, the auxiliary display AD may display management/audit screens that may be shown to an administrator or an operator of the gaming machine 1. The management screens may be locked in a normal state, and may be unlocked by an administration key, for example, a physical key or a soft key. The administrator may set various options for the gaming machine 1, for example, options for rendering effects for the symbols SB.

According to an embodiment of the present invention, the auxiliary display AD may also display images and/or information related to the game.

According to an embodiment of the present invention, the auxiliary display AD may be omitted when the symbol display SD displays virtual reels. In this case, the management screens may be displayed on the symbol display SD.

The administrator input unit IN2 may be configured to accept the administration key. The administrator input unit IN2 may generate a signal informing of reception of the key and send the signal to the controller CN. When the key is a mechanical key, the administrator input unit IN2 may be a hole for receiving the mechanical key. When the key is an electronic key, the administrator input unit IN2 may be a reader to be configured to read identification information from the electronic key. As described above, the key may be a soft key, and in this case, the administrator input unit IN2 may include a key board, a mouse, or a touch panel for inserting a password, etc. The touch panel for the administrator input unit IN2 may be disposed in front of the auxiliary display AD.

The administrator input unit IN2 and the player input unit IN1 may be integrated into a single module.

An example of a set of audit screens are shown in FIG. 4 to FIG. 7.

Figure 4:
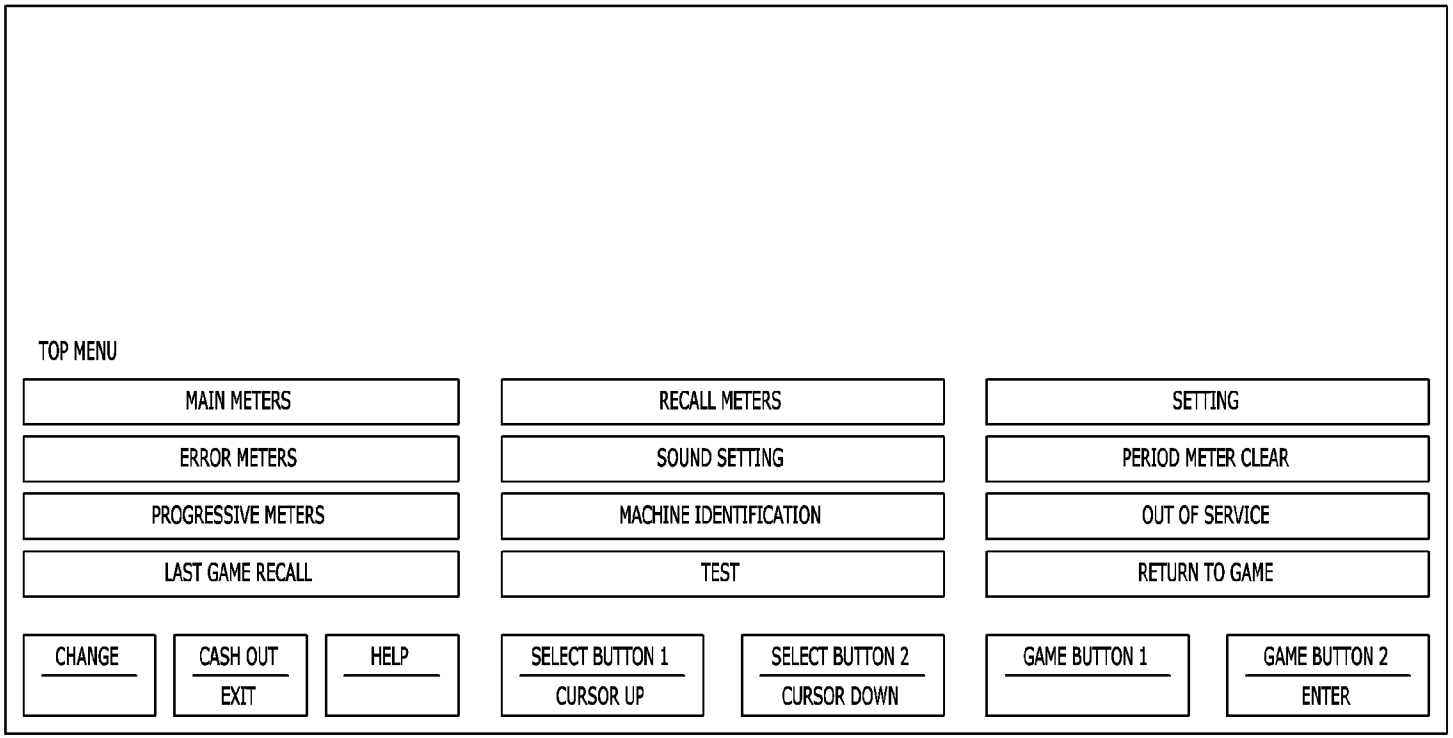
FIG. 4 to FIG. 7 are exemplary audit screens according an embodiment of the present invention.

Referring to FIG. 4, a first audit screen may show a top menu. The top menu may include "main meters," "error meters," "progressive meters," "last game recall," "recall meters," "sound setting," "machine identification," "test," "setting," "period meter clear," "out of service," and "return to game." The first audit screen may further show a plurality of push buttons, for example, "CHANGE," "CASH OUT/EXIT," "HELP," "SELECT BUTTON 1/CURSOR UP," "SELECT BUTTON 2/CURSOR DOWN," "GAME BUTTON 1," and "GAME BUTTON 2/ENTER." An operator or an administrator may move a cursor up and down using the buttons "SELECT BUTTON 1/CURSOR UP" and "SELECT BUTTON 2/CURSOR DOWN," respectively, and may select an item in the top menu using the button "GAME BUTTON 2/ENTER."

Figure 5:
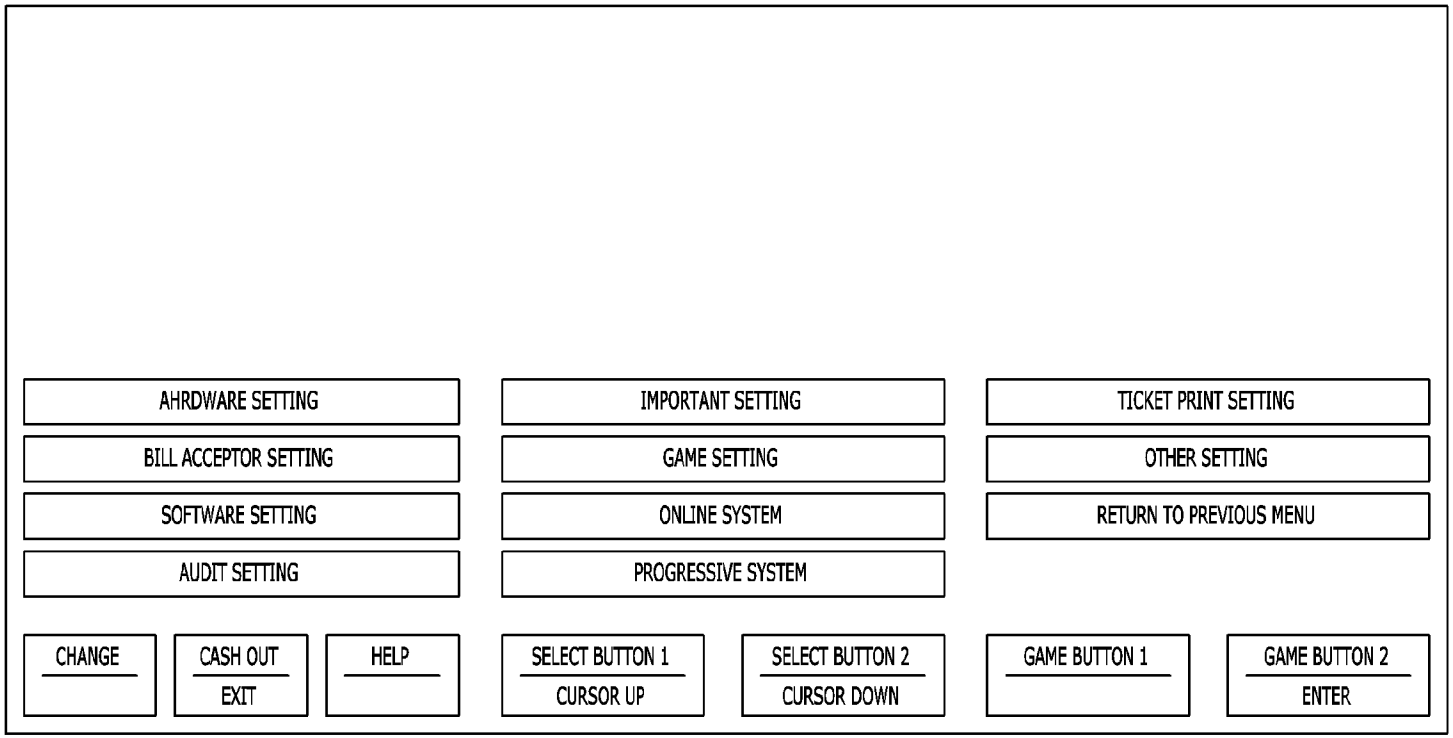

Referring to FIG. 5, a second audit screen may show a setting menu which is shown when the item "setting" in FIG. 4 is selected. The setting menu may include "hardware setting," "bill acceptor setting," "software setting," "audit setting," "important setting," "game setting," "online system," "progressive system," "ticket print setting", "other setting," and "return to previous menu." The second audit screen may also show the push buttons shown in FIG. 4, and the operator may select a an item in the setting menu using the push buttons. The operator may return to the top menu by selecting "return to previous menu."

Figure 6:
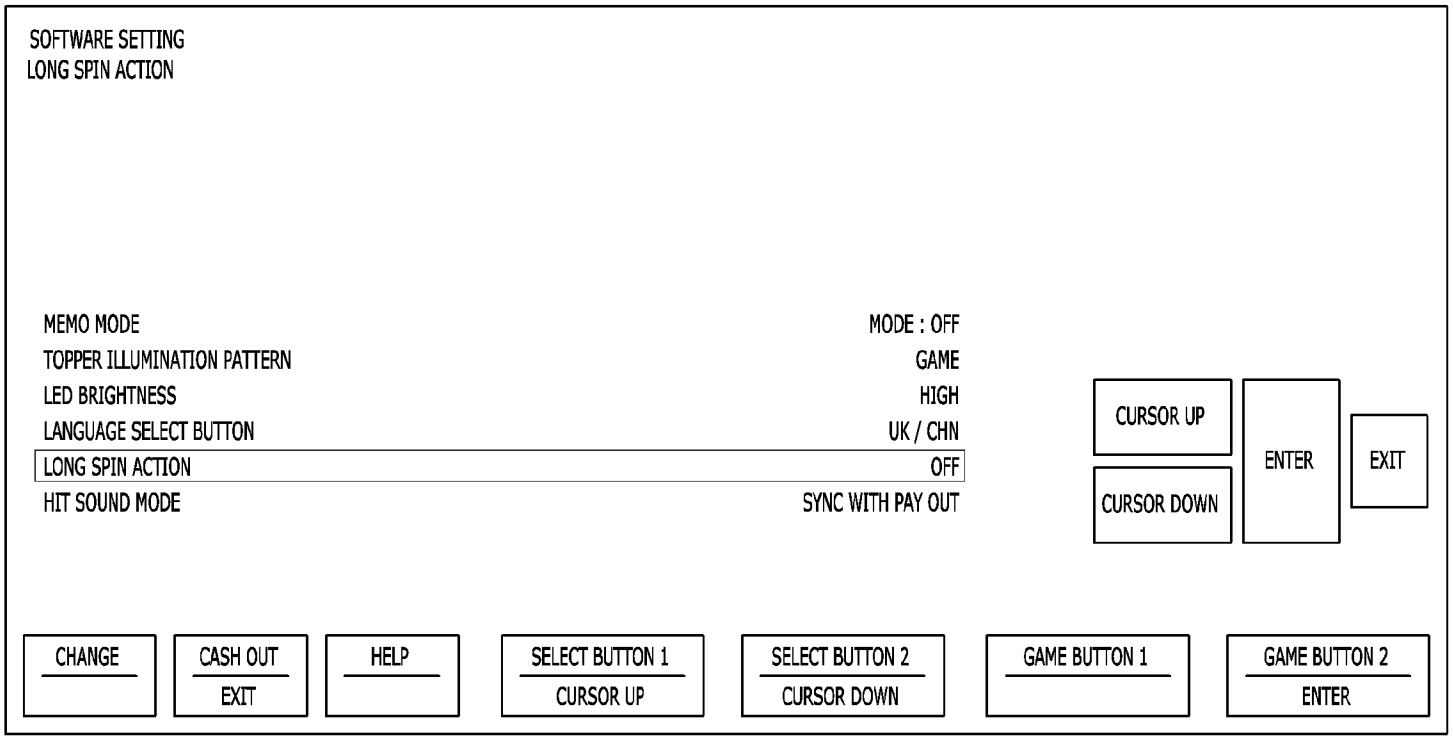

Referring to FIG. 6, a third audit screen may show a software setting menu which is shown when the operator selects "software setting" in FIG. 5. The software setting menu may include "demo mode," "topper illumination pattern," "LED brightness," "language select button," "long spin action," and "hit sound mode." The third audit screen may further show a plurality of buttons "CURSOR UP," "CURSOR DOWN," "ENTER," and "EXIT," as well as the push buttons shown in FIG. 4 and FIG. 5. The operator or an administrator may move a cursor up and down using the buttons "CURSOR UP" and "CURSOR DOWN," respectively, and may select an item in the software setting menu using the button "ENTER." When the button EXIT is pushed, the screen may return to the second audit screen.

Figure 7:
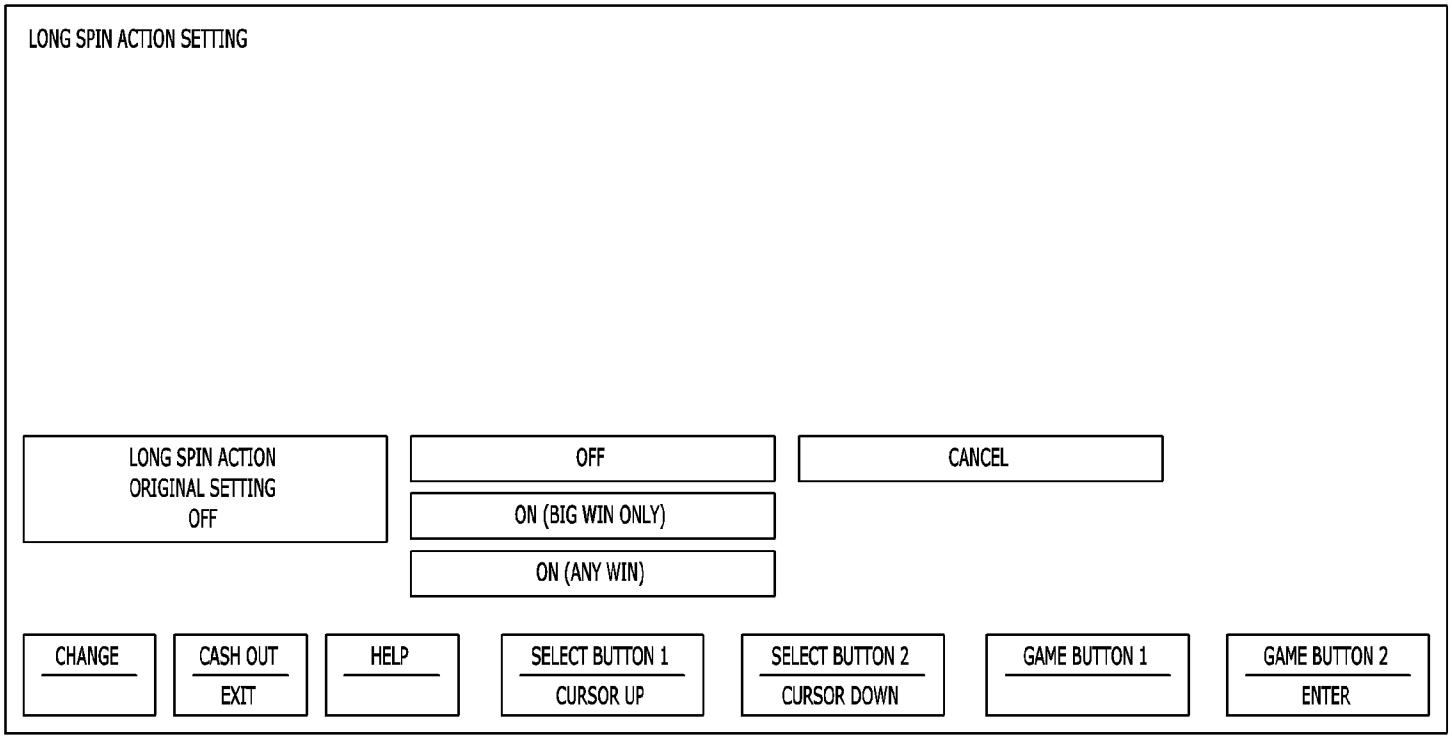

Referring to FIG. 7, a fourth audit screen may show a long spin action setting menu which is shown when the operator selects "long spin action" in FIG. 6. The long spin action setting menu may include "OFF," "ON (BIG WIN ONLY)," "ON (ANY WIN)," and "CANCEL." A long spin action, which will be described later in detail, of the symbols SB may be activated when the item "ON (BIG WIN ONLY)" or "ON (ANY WIN)" is selected. When the button "ON (BIG WIN ONLY)" is selected, the long spin action is performed only for big wins. When the button "ON (ANY WIN)" is selected, the long spin action is performed only for any big wins. The fourth audit screen may also show the push buttons shown in FIG. 4 to FIG. 6, and the operator may select a an item in the setting menu using the push buttons. The operator may cancel the setting by selecting the item "CANCEL."

According to an embodiment, the item "long spin action" may be substituted with "rendering effect," "rendering movement," "sound effect," or "visual effect."

The memory MM may store the setting established through the audit screens. The memory MM may further store a plurality of rendering patterns that determine patterns of rendering effects. For example, the rendering patterns may determine at least one of moving patterns or spinning and stopping patterns of the symbols SB, patterns of sound effects, and patterns of visual effects. One of the moving patterns may include the above-described long spin action. The rendering patterns may be determined depending on a determined symbol arrangement. According to an embodiment, rendering patterns for a symbol arrangement including a winning combination may be different from a rendering pattern for a symbol arrangement including no winning combination. According to an embodiment, a rendering pattern for a symbol arrangement including a big win may be different from a rendering pattern for a symbol arrangement including an ordinary win.

The memory MM may further store a prize table for determining a prize for each win, and the win may be formed by at least one of the win-related symbols.

The player input unit IN1 includes a plurality of buttons BT, for example, a bet button B1 and a spin button S1 that are operable by a player. The bet button B1 is used for betting on a game, and the spin button B2 is used for spinning the reels RL to get a new arrangement of the symbols SB (or for starting the game).

The controller CN receives inputs from the player input unit IN1 and controls the symbol display SD with the symbols SB in response to inputs from the player input unit IN1.

Now, a gaming method including the setting operation according to one or more embodiments of the present invention is described in detail with reference to FIG. 8, FIG. 9A and FIG. 9B as well as FIG. 1 to FIG. 7.

Figure 8:
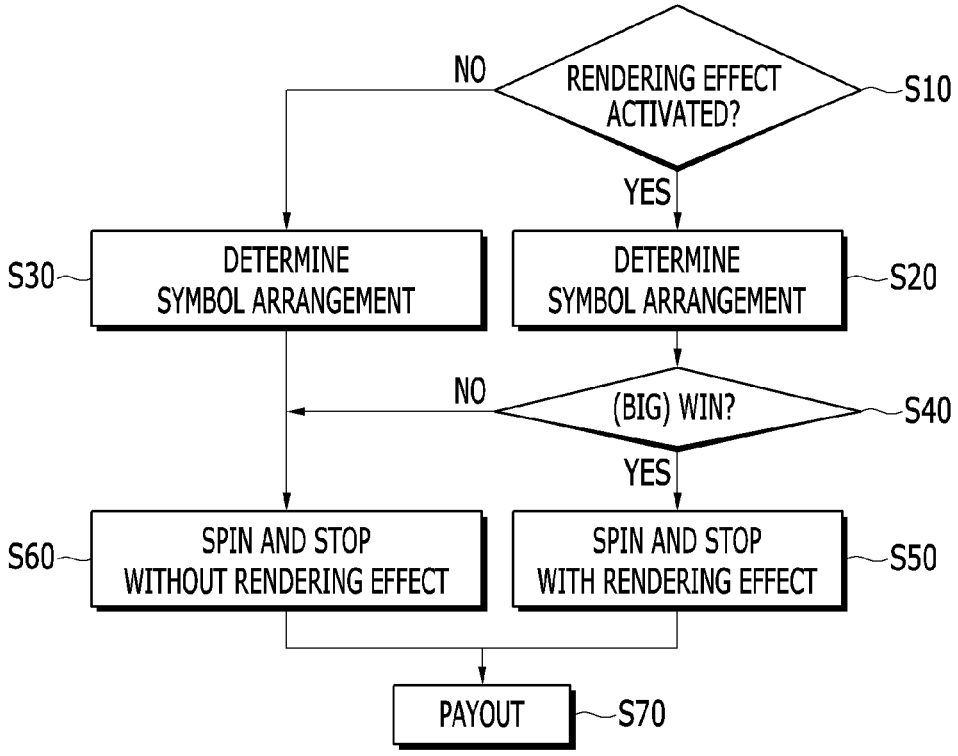
FIG. 8 is a schematic flow chart illustrating a gaming method according to an embodiment of the present invention.
Figure 9A:
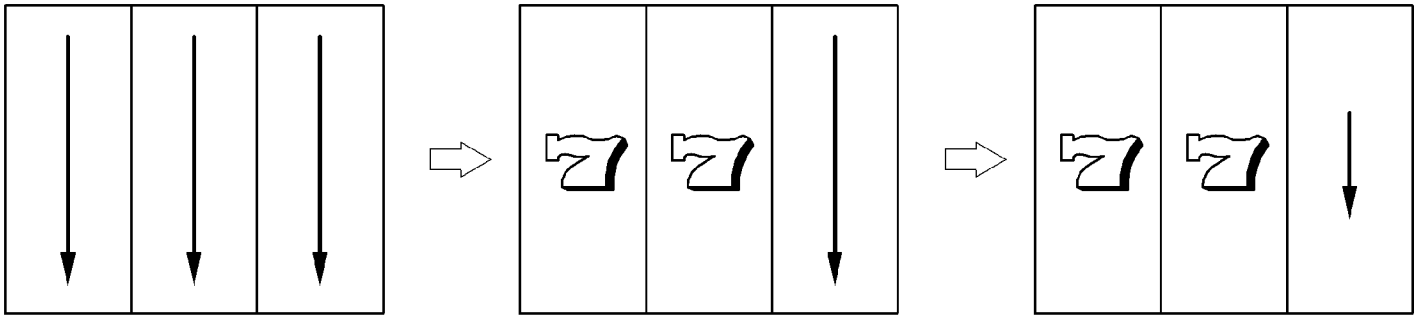
FIG. 9A is screen shots illustrating an exemplary rendering movement.
Figure 9B:
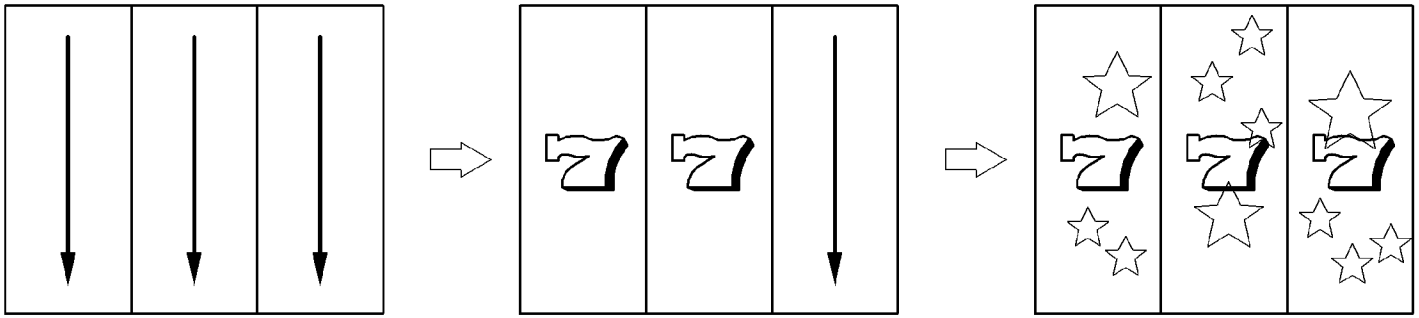
FIG. 9B is screen shots illustrating a visual effect.

FIG. 8 is a schematic flow chart illustrating a gaming method according to an embodiment of the present invention, FIG. 9A is screen shots illustrating an exemplary rendering movement of symbols, and FIG. 9B is screen shots illustrating an exemplary visual effects.

Referring to FIG. 8, the controller CN may determine whether a rendering effect activation is selected (S10). The selection of the rendering effect may be performed by an administrator through the administrator input unit IN2 in a way described with reference to FIG. 4 to FIG. 7.

The controller CN of the gaming machine 1 may make the symbol display SD display a plurality of symbols SB before starting a game, and the controller CN executes a round of the game in response to inputs from a player. The inputs from the player may include an input from the bet button B1 and another input from the spin button B2 shown in FIG. 1. The player may determine a bet amount by pressing the bet button B1, and starts the game round by pressing the spin button B2.

The controller CN may determine a symbol arrangement including a group of symbols selected from a predetermined symbol code table, for example, by using a random number generator (not shown) upon receipt of the input from the spin button B2 (S20, S30).

After determining the symbol arrangement, the controller CN determines whether the symbol arrangement includes a win (or a big win) (S40) when it is determined that a rendering effect activation is selected (S10:YES). The big win may be defined case by case.

Table 1 is an exemplary pay table for three same symbols on a payline for the symbol set shown in FIG. 3. In this example, three RED7s, three WILDs, and three DJPs may be defined as big wins. In Table 1, "Mixed BARs" denotes any combination of the symbols 1BAR, 2BAR, and 3BAR.

TABLE 1

| Symbol (3) | Prize |
|---|---|
| DJP | 2500 |
| WILD | 300 |
| RED7 | 150 |
| 3BAR | 50 |
| 2BAR | 20 |
| 1BAR | 10 |
| Mixed BARs | 5 |

When it is determined that the symbol arrangement includes a win (or a big win) (S40: YES), the controller CN spins and stops the symbols with the rendering effect (S50). On the contrary, when it is determined that the symbol arrangement includes no win (or no big win) (S40: NO), the controller CN spins and stops the symbols without the rendering effect (S60).

As described above, the rendering effect includes rendering movements of the symbols SB, visual effects, and sound effects.

Referring to FIG. 9A, in an exemplary rendering movement of the symbols SB, a last reel may spin extraordinary slowly after a first reel and a second reel stop spinning, which may be referred to as a "long spin action." According to another embodiment of the present invention, the last reel may spin in a reverse direction, or may spin slow and fast in an alternate manner. However, the rendering movements are not be limited to those described above. For example, at least one of the three reels may move in an extraordinary way.

Referring to FIG. 9B, in an exemplary visual effect, an image such as stars, thunderbolts, etc., is shown in at least one of the symbol display SD and the auxiliary display AD. The image may be shown after the reels stop or in the middle of the spinning. However, visual effects are not limited to those described above.

The rendering movements, the visual effects, and the sound effects may be performed solely or in combination.

Finally, the controller CN performs a payout process for the game (S70).

The rendering effects may cause slow progress in game plays. For example, an execution duration of a game with a rendering effect may be longer than an execution duration of a game without a rendering effect. Some players may want a speedy progress of game plays, and in addition, an administrator may also wish to fast progress of game plays to get higher rate of operation of the gaming machine 1. According to the embodiments of the present invention, the administrator may or may not select rendering effect activation based on his or her needs or players' needs.

Outline of Gaming Machine

A gaming machine according to another embodiment of the present invention is described with reference to FIG. 10 to FIG. 15.

Figure 10:
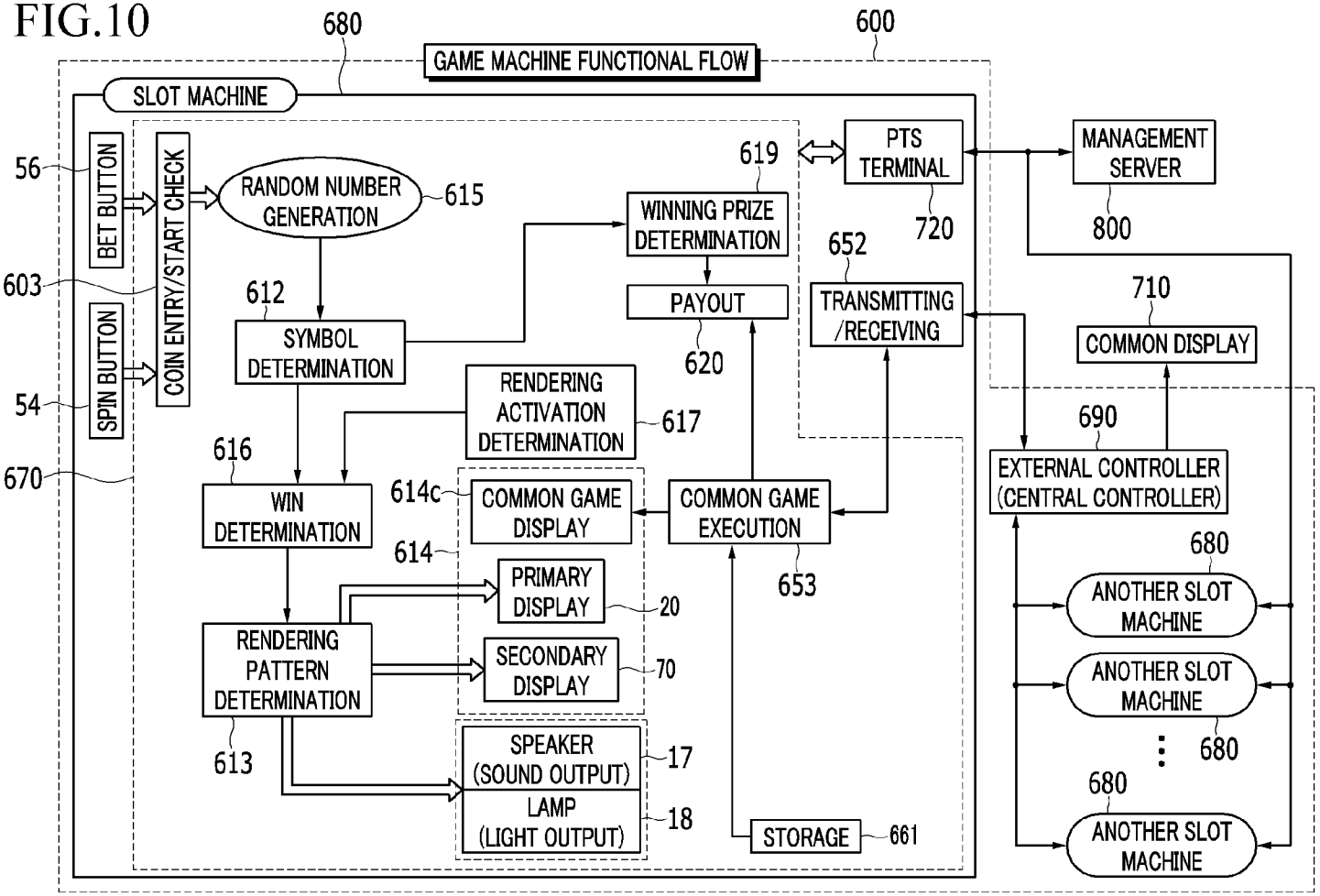
FIG. 10 is a schematic block diagram of an exemplary gaming machine showing a functional flow of the gaming machine.
Figure 11:
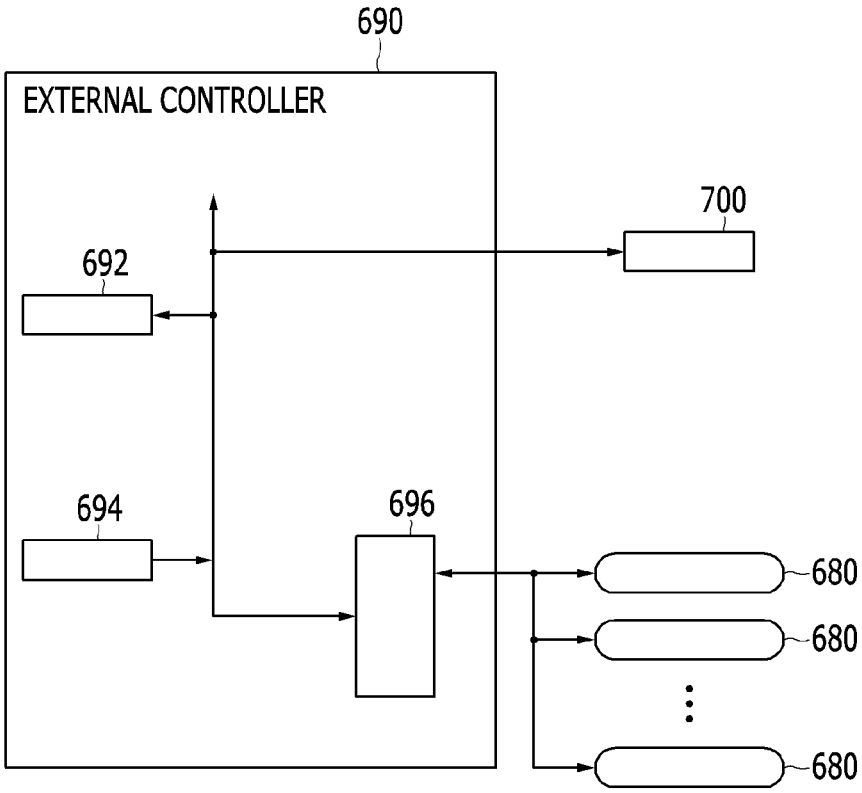
FIG. 11 is a schematic block diagram of an exemplary external controller.
Figure 12:
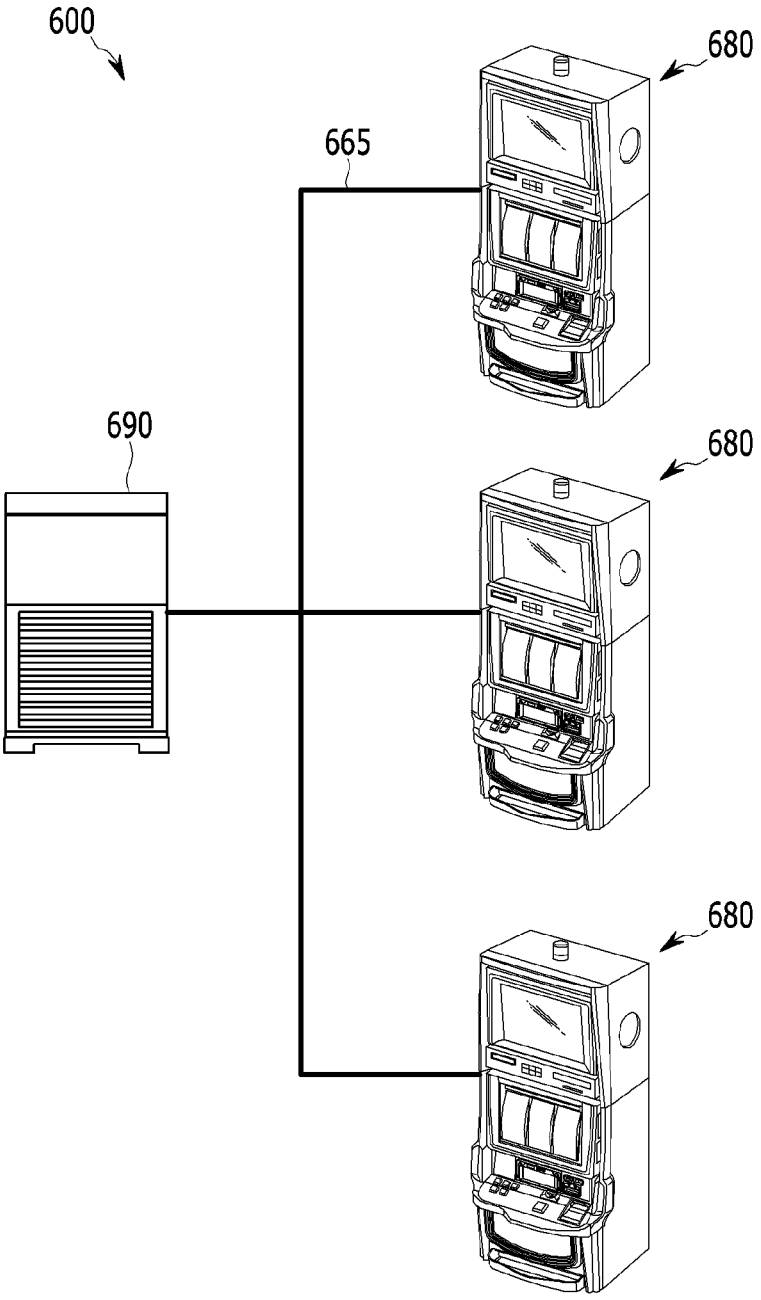
FIG. 12 is a schematic perspective view of an exemplary gaming machine.
Figure 13:
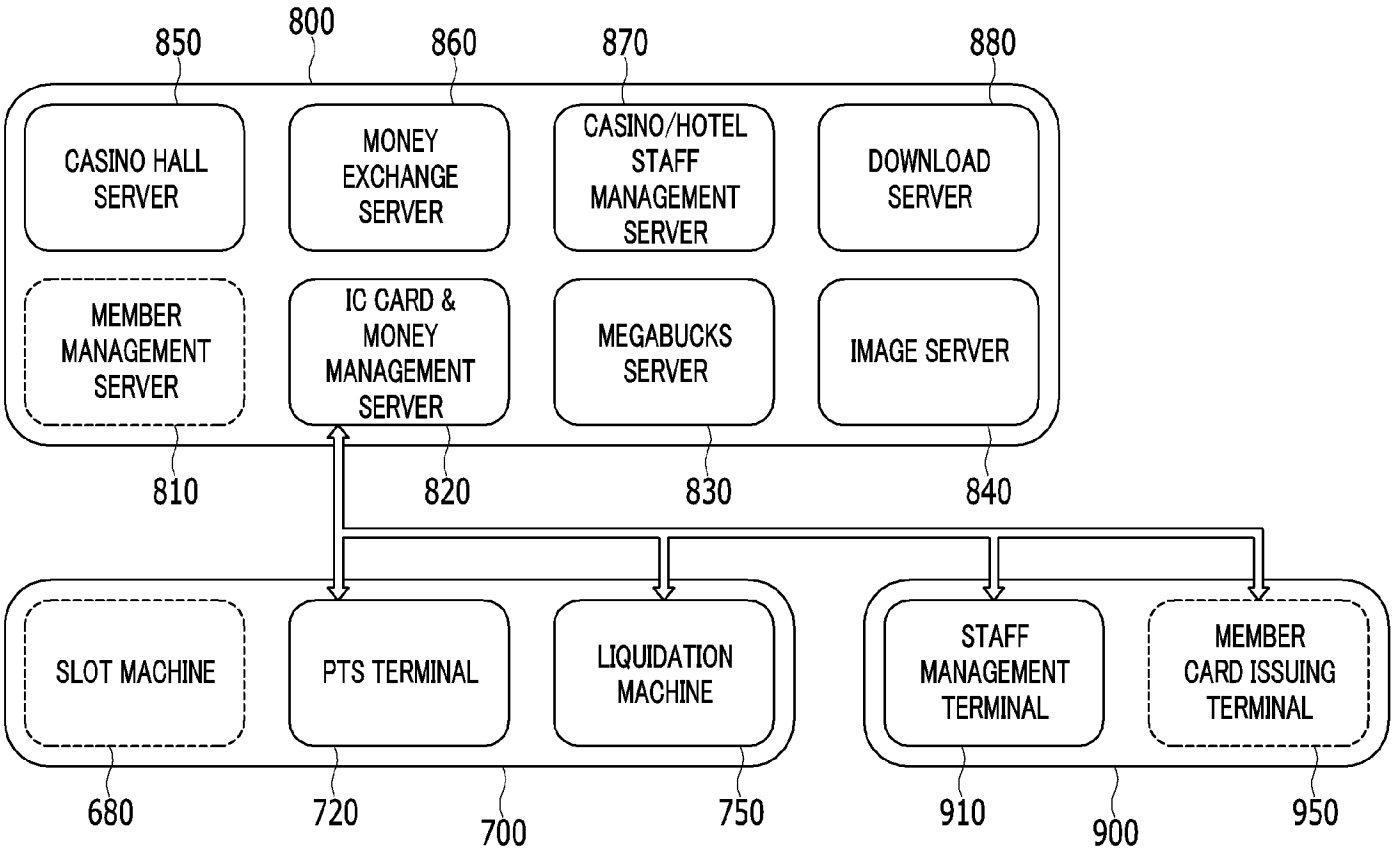
FIG. 13 is a schematic block diagram of an exemplary gaming system.
Figure 14:
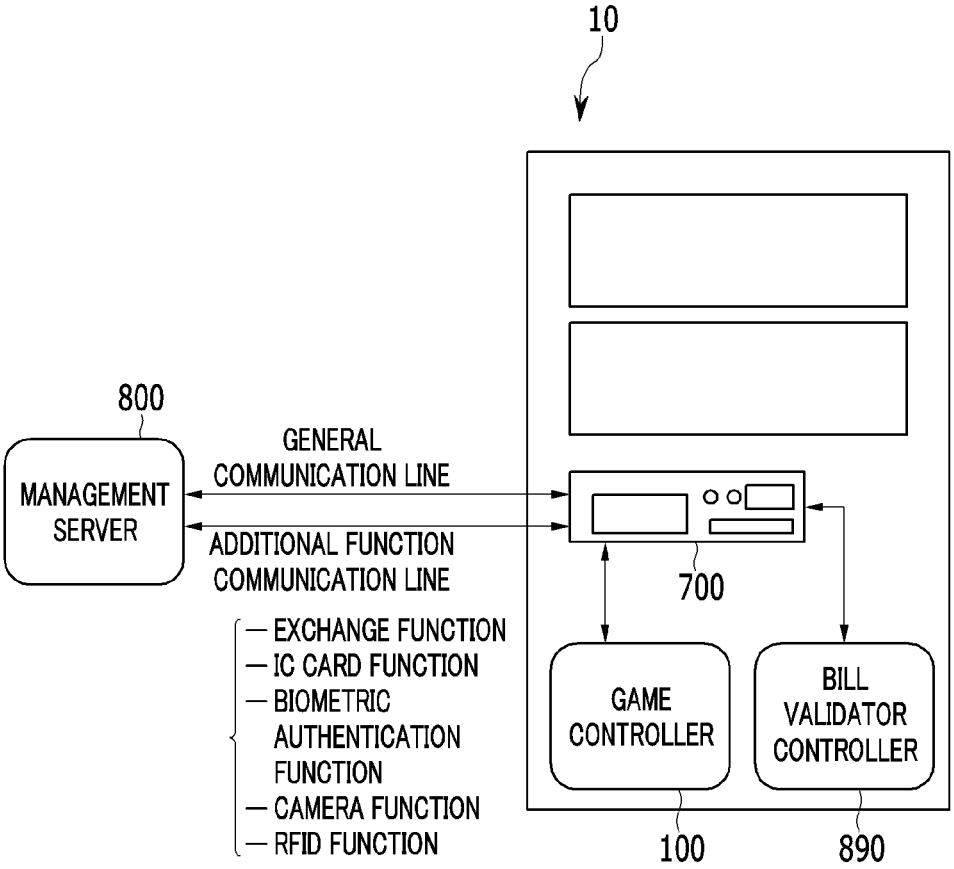
FIG. 14 is a schematic block diagram of an exemplary PTS system of a gaming machine.
Figure 15:
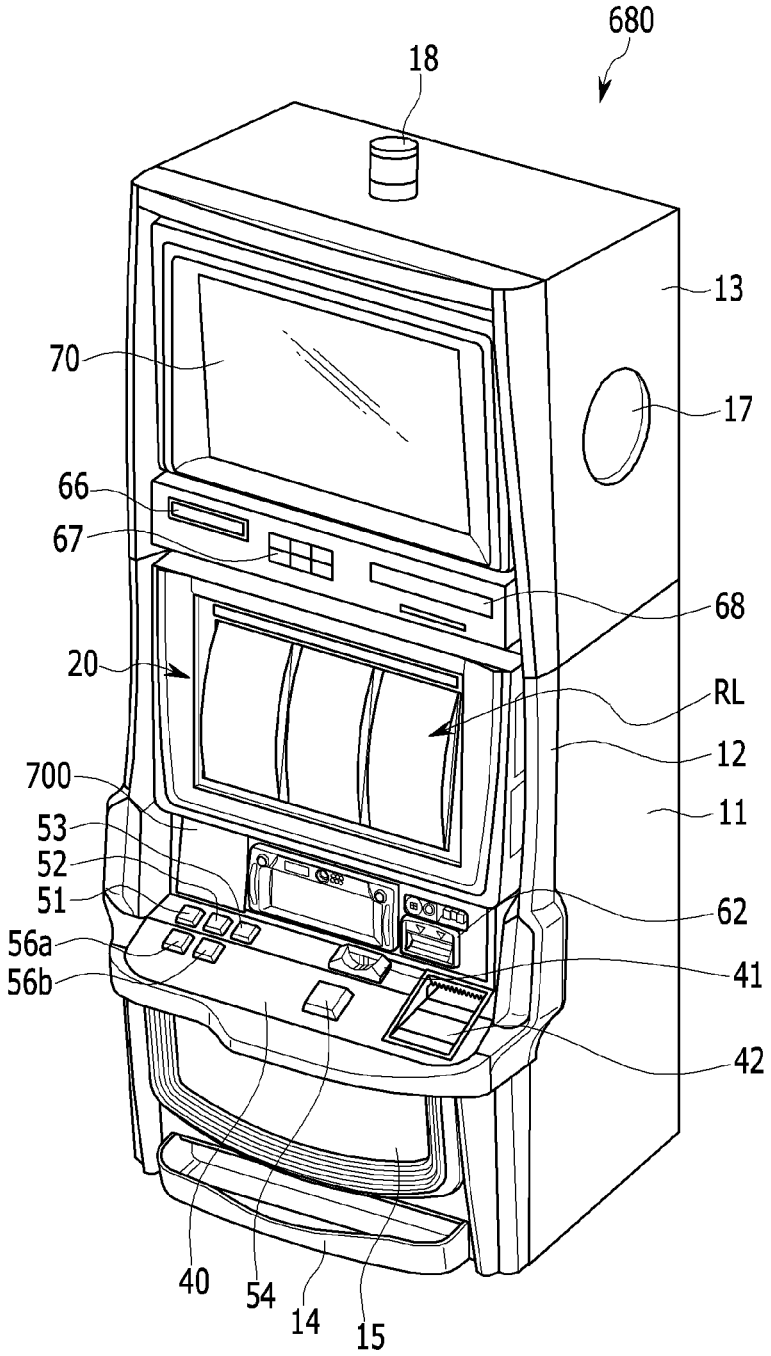
FIG. 15 is a schematic perspective view of an exemplary slot machine in a gaming machine according to an embodiment.

FIG. 10 is a schematic block diagram of an exemplary gaming machine showing a functional flow of the gaming machine, FIG. 11 is a schematic block diagram of an exemplary external controller, FIG. 12 is a schematic perspective view of an exemplary gaming machine, FIG. 13 is a schematic block diagram of an exemplary gaming system, FIG. 14 is a schematic block diagram of an exemplary PTS system of a gaming machine, and FIG. 15 is a schematic perspective view of an exemplary slot machine in a gaming machine according to an embodiment.

Functional Flow of Gaming Machine: Slot Machine

Referring to FIG. 10, a gaming machine 600 according to an embodiment includes a plurality of slot machines 680 and an external controller (or a central controller) 690 connected to the plurality of slot machines 680 such that the external controller 690 may perform data communication with the plurality of slot machines 680.

Each of the slot machines 680 includes a display unit 614, a player tracker system (PTS) terminal 720, bet buttons 56, a spin button 54, a speaker 17, a lamp 18, and a game controller 670 controlling thereof. The slot machine 680 further includes a transceiver 652 for data communication with the external controller 690.

The bet buttons 56 and the spin button 54 are input elements that operate by pushing or pressing of a player. The bet buttons 56 are configured to accept a bet amount, and the spin button 54 is configured to accept start of a game.

The display unit 614 displays a plurality of symbols, and images, numbers, or signs related to game information and visual rendering effects. The display unit 614 includes a primary display 20, a secondary display 70, and a common game display 614*c*. The primary display 20 displays symbols for a game, and the secondary display 70 displays a variety of images and information related to the game. The common game display 614*c* is adapted to display a common game such as a jackpot game, for example.

The game controller 670 includes a coin insertion/start check unit 603, a random number generator 615, a symbol determining unit 612, a win determining unit 616, a rendering activation determining unit 617, a rendering pattern determining unit 613, a winning prize determining unit 619, and a payout unit 620.

The symbol determining unit 612 is configured: to determine a symbol arrangement using random numbers generated by the random number generator 615; to output the symbol arrangement to the primary display 20 of the display unit 614 to display the symbol arrangement thereon; to output information on the symbol arrangement to the winning prize determining unit 619; and to output information on the symbol arrangement to the win determining unit 616.

The rendering activation determining unit 617 is configured to determine whether the rendering effect is activated, and to output information related to the rendering effect activation to the win determining unit 616. The win determining 616 is configured to determine whether the symbol arrangement includes a win or whether the symbol arrangement includes a big win when the rendering effect is activated, and to output information related to the presence of a win or big win to the rendering pattern determining unit 613. The rendering pattern determining unit 613 is configured: to determine the rendering pattern, for example, with the use of the random number; to output the information on the rendering movement of the symbols based on the determined rendering pattern to the primary display 20 of the display unit 614; to output the determined rendering pattern to the primary and secondary displays 20 and 70 of the display unit 614; and to output sound/lighting information of the determined rendering mode to the speaker 17 and the lamp 18.

The winning prize determining unit 619 is configured to determine the presence or absence of a winning prize based on the arrangement of the symbols displayed on the primary display 20; to calculate a payout amount based on the types of wins and betting amount; and to output a payout signal that informs of the payout amount to the payout unit 620. The payout unit 620 is configured to pay out the amount to a player in a form of a coin, a medal, a credit, or the like. In addition, the payout unit 620 is configured to add credit data based on a credit to be paid out to the credit that is stored in an IC card 500 inserted into a PTS terminal 720 to be described later.

Furthermore, the game controller 670 includes a storage 661 configured to store a variety of bet amount data. The storage 661 is a device configured to store data contained in a hard disk unit or a memory in a rewritable manner.

Moreover, the game controller 670 includes a common game executing unit 653. The common game executing unit 653 is configured to output bet amount information that is based on a bet amount betted in a game to the external controller 690 every time unit game is played; to execute a common game by means of a game start command from the external controller 690; and to accept a BET input by means of the bet buttons 56 as to a bet amount that corresponds to data on a bet amount data for common game that can be betted in a common game.

The game controller 670 is connected to the PTS terminal 720. The PTS terminal 720 may be configured to communicate with the game controller 670, for example, to send credit data, for example. The game controller 670 may update credits written on the display unit 614 when the credit controller receives the credit data from the PTS terminal 720. The game controller 670 may output liquidation credit data to the PTS terminal 720 in a case where a game liquidation has occurred.

The PTS terminal 720 is connected to a management server 800 to enable communication therewith, and integrally performs image downloading or management of IC card or credit.

Functional Flow of Gaming Machine: External Control Device

Referring to FIG. 11, the slot machines 680 are connected to an external controller 690. The external controller 690 has a function of remotely operating and remotely monitoring an operating state of each slot machine 680 or a processing operation such as changing a variety of game setting values. Furthermore, the external controller 690 has a function of determining a common game start condition for each game terminal and then executing a common game in a plurality of slot machines 680 when a determination result satisfying the common game start condition has been obtained in any of the game terminals.

The external controller 690 includes a common game start unit 694, a game terminal selecting unit 692, and a transceiver 696.

The common game start unit 694 is configured: to determine whether or not a common game start condition is established, based on a cumulative value of bet amount information that is transmitted from a slot machine 680 in each game round; to output a game start command to a plurality of slot machine 680; and to display a state that is established until the common game start condition has been established on the common display device 700.

Determination of whether or not the common game start condition is established may be made based on all of the cumulative values that are obtained by repetition of a unit game as well as based on a cumulative value of bet amount information. For example, the number of games or a game playing time and the like may be a cumulative value.

Furthermore, the common game start unit 694 is configured to output a game start command to a slot machine 680 in which a cumulative value increasing due to repetition of a game satisfies a game execution condition. In this manner, the common game start unit 694 enables a player to have a consciousness to actively repeat a game because a qualification to participate in a common game is not provided to a slot machine 680 whose cumulative value is less than a minimum setting value.

Furthermore, the common game start unit 694 is configured to monitor a non-input time during which no start operation is made and then outputting a game start command to the slot machines 680 other than a slot machine 680 whose non-input time is more than a timeout time. In this manner, the common game start unit 694 is capable of determining that a player is absent as to a slot machine 680 in which no game is executed over a timeout time or more, and is capable of avoiding execution of a common game for such a slot machine 680.

The game terminal selecting unit 692 has a function of selecting a specific slot machine 680 from among a plurality of slot machines 680 and then outputting a common game start command signal to the specific slot machine 680. The transceiver 696 has a function enabling transmission/reception of data to/from the slot machine 680.

Entire Configuration of Game System

A game system that includes gaming machines 600 having the respective functions described above is described.

Referring to FIG. 12, a gaming machine 600 includes a plurality of slot machines 680 and an external controller 690 that is connected to each of the slot machines 680 via a communication line 665.

The external controller 690 is configured to control a plurality of slot machines 680. In the embodiment, the external controller 690 is a so called hall server that is installed in a gaming facility having a plurality of slot machines 680. Each of the slot machines 680 has its own identification number assigned thereto, and the external controller 690 determines a source of data to be transmitted from each of the slot machines 680, in accordance with the assigned identification number. In addition, in a case where data is transmitted from the external controller 690 to a slot machine 680 as well, a transmission destination is specified with the use of the assigned identification number.

A game system may be configured in one gaming facility that is capable of performing a variety of games, such as a casino, or may be constructed across a plurality of gaming facilities. In a case where the game system is constructed in one gaming facility, the game system may be constructed every floor or every section in the gaming facility. The communication line 665 may be wired or wireless, and a leased line or a switched line and the like can be employed.

Referring to FIG. 13, a game system is divided into three sections, i.e. a management server block 800, a customer terminal block 700, and a staff terminal block 900. The management server block 800 includes a casino hall server 850, a money exchange server 860, a casino/hotel staff management server 870, and a download server 880.

The casino hall sever 850 is a server configured to manage an entire casino hall in which slot machines 680 have been installed. The money exchange server 860 is a server configured to prepare money exchange rate data based on money exchange information. The casino/hotel staff management server 870 is a server configured to manage staffs in a casino hall or a hotel associated with the casino hall. The download server 880 is a server configured to download information relating to games or the latest information such as news and then broadcast the downloaded information to players through the PTS terminals 700 of a variety of slot machines 680.

In addition, the management server block 800 has a member management server 810, an IC card & money management server 820, a megabucks server 830, and an image server 840.

The member management server 810 is a server configured to manage members information on a player who plays a game at a slot machine 680. The IC card & money management server 820 is a server configured to manage an IC card 500 used in a slot machine 680. Specifically, the IC card & money management server 820 is a server configured to store fraction money data to be associated with an identification code or to output the fraction money data to the PTS terminal 720. The IC card & money management server 820 is also configured to prepare and manage denomination data or the like. The megabucks server 830 is a server configured to manage megabucks serving as games in which a total amount of betted money in a plurality of slot machines 680 installed in a plurality of casino hall is determined as a prize. The image server 840 is a server configured to download an image relating to a game or a latest image such as news, for example, and then, broadcast the downloaded image to players through the PTS terminal 720 of a variety of slot machines 680.

The customer terminal block 700 has a slot machine 680, a PTS terminal 720, and a liquidation machine 750. The PTS terminal 700 can be mounted on the slot machine 680 and can communicate with the management server 800. The liquidation machine 750 is a machine configured to cash out and liquidate money data that is stored in an IC card 500 that a player owns or to store a coin or a bill as money data in the IC card 500.

The staff terminal block 900 has a staff management terminal 900 and a member card issuing terminal 950. The staff management terminal 900 is a terminal for staffs in a casino hall to manage a variety of slot machines 680. In particular, in the case of the embodiment, the staffs in a casino hall manage whether too many IC cards 500 are stocked in the PTS terminal 720 or the number of IC cards 500 is insufficient. The member card issuing terminal 950 is a terminal for a player who plays a game in a casino hall to use when issuing a member card.

PTS Terminal

Referring to FIG. 14, a PTS terminal 720 is incorporated in a PTS system. The PTS terminal 720 that is mounted on a slot machine 680 is connected to a game controller 670 and a bill validator controller 890 of the slot machine 680 to enable communication therewith.

The PTS terminal 720 performs rendering of a game by means of sound or image and the like or updating of credit data in communication with the game controller 670. In addition, the PTS terminal 720 transmits credit data required for liquidation in communication with the bill validator controller 890.

In addition, the PTS terminal 720 is connected to a management server 800 to enable communication therewith. The PTS terminal 720 communicates with the management server 800 between two lines, i.e., between a general communication line and an additional function communication line.

The PTS terminal 720 makes communication of data such as money data or identification code data or members information on players, for example, in the general communication line. On the other hand, the PTS terminal 720 makes communication relating to functions to be newly added in the additional function communication line. In the case of the embodiment, the PTS terminal 720 makes communication relating to an exchange function, an IC card function, a biological authentication function, a camera function, or an RFID (Radio Frequency IDentification) function serving as a function of making solid identification with the use of radio waves.

Mechanical Configuration of Slot Machine

An exemplary structure of the slot machine 680 that includes elements other than those above listed is shown in FIG. 15, but the structure of the slot machine 680 is not limited thereto.

Referring to FIG. 15, the slot machine 680 includes a cabinet 11, a top box 12, a main door 13, a primary display 20, a secondary display 70, a control panel 40, a speaker 17, and a lamp 18.

The primary display 20 displays a symbol arrangement among a set of symbols SB disposed on a plurality of, for example, three reels RL. The primary display 20 may be disposed on an upper part of the main door 13 that may be provided on a front surface of the cabinet 11, and may include an LCD panel or an OLED panel. The primary display 20 may include a touch screen panel that enables a player to interact with the slot machine 680 by touching some areas on a screen.

The secondary display 70 displays images related to game information or images, for example, a management/audit screen. The secondary display 70 may be disposed on a front surface of the top box that may be provided on the cabinet 11, and may include a display panel, for example, a liquid crystal display (LCD) panel or an organic light emitting display (OLED).

Referring to FIG. 15, the control panel 40 includes a plurality of buttons, a coin entry 41, and a bill entry 43, and may be disposed below the primary display 20.

The plurality of buttons 51-54, 56*a* and 56*b* may include a reserve button 51, a take win button (or collect button) 52, and a game-rules button (or help button) 53 that may be disposed on an upper stage of a left area of the control panel 40. The plurality of buttons may further include a plurality of bet buttons including a bet 1 button 56*a* and a max bet button 56*b* that may be disposed at a lower stage of in a left area. The plurality of buttons 51-54, 56*a* and 56*b* may further include a start button (or repeat button) 54 that may be disposed right to the bet buttons 56*a* and 56*b*. The coin entry 41 and the bill entry 43 may be disposed upper to the start button 54.

The reserve button 51 may be an operating button to be used when a player wants to leave a seat or when a player wants to request the staffs in a gaming facility to exchange money. The take win button 52 may be a cash-out button used to add the credit data relating to credits obtained in a variety of games to the credit data that is stored in the smart card or output the bill or the ticket corresponding to the total credits. The help button 53 may be a button to be used when a user does not clearly understand how to play a game or the like, and when the help button 53 is pressed, a variety of help information including game rules may be displayed on the secondary display 70.

The bet-1 button 56*a* may be used when player's current credits are betted on a one-by-one basis for a winning payline every time the button is pressed. The slot machine 680 may restrict an upper limit of the bet amount.

The max bet button 56*b* may be an operating button to be used when a maximum amount are betted.

The spin button 54 may be an operating button to be used when scrolling symbols in a game and when starting a rotation of a selection wheel in a bonus game.

The coin entry 41 may be configured to accept the coin in the cabinet 11. The bill entry 43 may be configured to validate whether the entered bill is legitimate or not and to accept a legitimate bill in the cabinet 11. Moreover, the bill entry 43 may accept the ticket having the barcode.

The slot machine 680 may further include an integrated circuit (IC) card reader 62 disposed below the primary display 20. The IC card reader 62 receives an IC card which stores information of player identification and game log related with the games previously played by the player, for example. In addition, the IC card may store data equivalent to coins, bills, or credits owned by the player. The IC card reader 62 reads and writes data from and to the inserted IC card. The IC card reader 62 may include an LCD for displaying the data read from the IC card.

The slot machine 680 further include a speaker 17 for outputting sound effects and a lamp 18 for light flashing.

Electronic Configuration of Slot Machine

Next, a configuration of a circuit included in a slot machine 680 will be described with reference to FIG. 16.

Figure 16:
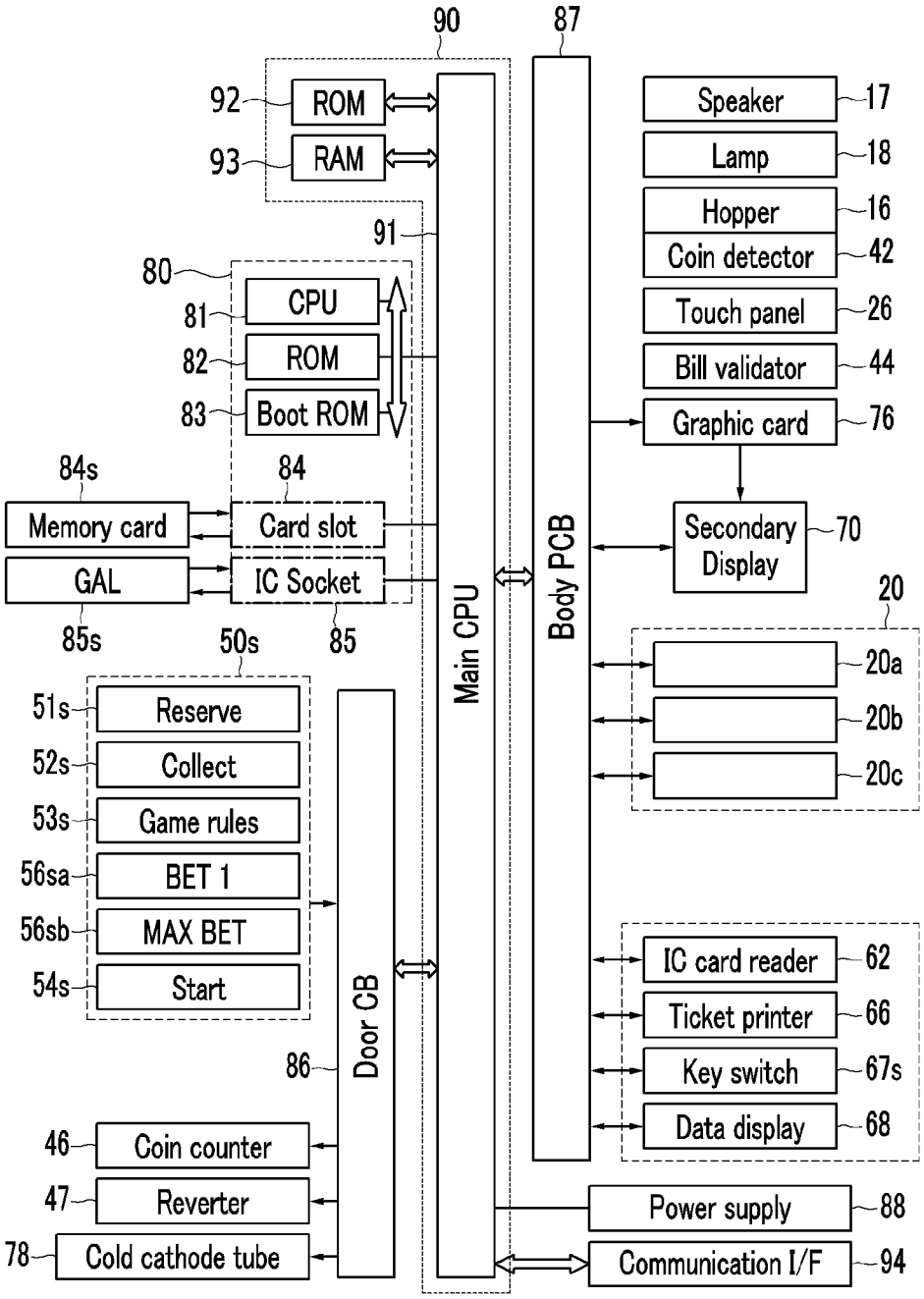
FIG. 16 is a schematic block diagram of circuit configuration for a gaming machine according to an embodiment of the present invention.

Referring to FIG. 16, the slot machine 680 includes a gaming board 80, a motherboard 90, and a door PCB 86, and a body PCB 87.

A gaming board 80 includes a CPU 81, a ROM 82 accessible by the CPU 81 through an internal bus, and a boot ROM 83 accessible by the CPU 81 by an internal bus. The gaming board 80 additionally includes a card slot 84 which can receive and communicate with a memory card 84*s*, and an IC socket 85 provided correspondingly to a Generic Array Logic (GAL) 85*s*.

The memory card 84*s* includes a non-volatile memory and stores a game program and a game system program.

The card slot 84 is configured to receive and eject the memory card 84*s*, and is connected to a motherboard 90 by an IDE bus. The details of the game performed in the slot machine 1 can be changed by replacing the memory card 84*s* with another one, or by withdrawing the memory card 84*s* from card slot 84, writing another program into the memory card 84*s*, and then inserting the memory card 84*s* into the card slot 84 again.

The GAL 85*s*, which is a type of a Programmable Logic Device (PLD) having a fixed OR array structure, has a plurality of input ports and output ports. When the GAL 85*s* receives certain data through the input ports, it outputs data corresponding to the input data through the output ports.

The IC socket 85 is configured in such a manner that the GAL 85*s* can be inserted into the IC socket 85 or detached from the IC socket 85, and connected to a motherboard 90 by a PCI bus.

The CPU 81, the ROM 82, and the boot ROM 83 interconnected by the internal bus are connected to the motherboard 90 by the PCI bus. The PCI bus enables signal transmission between the motherboard 90 and the gaming board 80, and supply of power from the motherboard 90 to the gaming board 80.

The ROM 82 stores an authentication program. The boot ROM 83 stores a preliminary authentication program, a boot code to be used by the CPU 81 for activating the preliminary authentication program, and the like. The authentication program is a tamper check program for authenticating the originality of the game program and the game system program. The preliminary authentication program is a program for authenticating the originality of the authentication program. The authentication program and the preliminary authentication program are written in a sequence of proving that the subject program has not been tampered.

The motherboard 90, which may be implemented using a commonly available general main board, executes the game program and the game system program. The motherboard 90 includes a main CPU 91, a ROM 92, a RAM 93, and a communication interface 94.

The ROM 92, which may be a flash memory, may be configured to store a program to be executed by the main CPU 91 such as BIOS, along with another data to be maintained permanently. When being executed by the main CPU 91, the BIOS performs initialization of peripheral devices. Also, the BIOS starts to load the game program and the game system program stored in the memory card 54 through the gaming board 80. The ROM 92 may be rewritable. However, write-protected one might be used as the ROM 92 as well.

The RAM 93 stores data and programs which are used during the operation of the main CPU 91. For example, when the game program, the game system program, or the authentication program is to be loaded, the RAM 93 can store such programs. Also, the RAM 93 is provided with working space for the execution of the programs. Examples of the space include a space for storing the number of bets, the payout amount, the credit amount, and the like can be maintained during the execution of the game. Also, plurality of tables defining symbols, symbol codes, winning combinations, and their probabilities are maintained during the execution of the game. Further, the RAM 93 stores symbol code determination tables which stores mapping information between symbol codes and random number which can used for determining symbols based on random numbers. In particular, the RAM 93 maintains a mode flag indicating the gaming mode, along with a game and a game counter of which count value indicates the number of executed chance mode games or the number of possibly remaining chance mode games.

Also, the RAM 93 stores count values of a plurality of counters, which include a bet counter, a payout amount counter, a credit amount counter, and a chance mode game counter which counts the number of chance mode games. Alternatively, however, some of the count values can be maintained in an internal register of the main CPU 91.

The communication interface 94 facilitates data communication of the main CPU 91 with an external controller of, for example, a server through a communication channel.

Besides, the motherboard 90 is connected to the door PCB 86 and the body PCB 87 by USB communications. The motherboard 90 is also connected to a power supply 88. The main CPU 91 of the motherboard 90 boots up and operates using the power supplied from the power supply 88, and passes over some of the power to the gaming board 80 through the PCI bus so as to boot up the CPU 81. The door PCB 86 and the body PCB 87 are connected to input devices such as a switch and a sensor, and peripheral devices of which operation are controlled by the main CPU 91. Also, the door PCB 86 is connected with a control panel 40, a coin counter 46, a reverter 47, and a cold cathode tube 78.

The control panel 40 has a reserve switch 51*s*, a collect switch 52*s*, a game rule switch 53*s*, a start switch 54*s*, a BET1 switch 56*sa*, and a MAX BET switch 56*sb*, each of which is provided correspondingly to respective buttons 51-54, 56*a* and 56*b*. The switches 51*s* to 54*s*, 56*sa* and 56*sb* detects pressing of the respective buttons 51-54, 56*a* and 56*b* to output signals to the main CPU 91.

The coin counter 46 and the reverter 47 are disposed in the coin entry 41. The coin counter 46 validates legitimacy of coins inserted into the coin entry 41 in terms of material, shape, or the like. The coin counter 46 outputs a signal to the main CPU 91 when detecting a legitimate coin. Meanwhile, illegitimate coins are discharged to the coin tray 15. The reverter 47, which operates based upon a control signal from the main CPU 91, distributes the legitimate coins validated by the coin counter 46 into either a hopper 16 or a cash box (not shown in the drawing). The coins are guided into the hopper 16 when the hopper 16 is not filled with coins. Contrarily, however, the coins are guided into the cash box when the hopper 16 is filled with coins.

The cold cathode tube 78, which is disposed on the rear face of the secondary display 70, functions as a backlight and illuminates based on a control signal from the main CPU 91.

The body PCB 87 is connected with the speaker 17, the lamp 18, the hopper 16, a coin detector 42, the touch panel 26, a bill validator 44, a primary display 20, the IC card reader 62, a graphic card 76, the ticket printer 66, a key switch 67*s*, and the data display 68.

The lamp 18 flashes based upon a control signal from the main CPU 91. The speaker 17 outputs a sound such as BGM based upon the control signal from the main CPU 91.

The hopper 16, which operates based upon a control signal from the main CPU 91, pays out coins of the designated payout amount to the coin tray 15 through a coin payout exit formed between the belly glass 14 and the coin tray 15. The coin detector 42 detects coins paid out from the hopper 16 to output a detection signal to the main CPU 91.

The touch panel 26 detects a position touched by the player to provide the main CPU 91 with a position sense signal corresponding to the detected position. The bill validator 44 in the bill entry 43 provides, upon detection of a legitimate bill, the main CPU 91 with a bill detection signal corresponding to the bill amount.

The primary display 20 includes a plurality of, for example, three reels 20*a*, 20*b* and 20*c* carrying a plurality of symbols thereon.

The graphic card 76 controls a secondary display 70 in response to a control signal from the main CPU 91. The graphic card 76 may include a Video Display Processor (VDP) generating video data, and a video RAM temporarily storing the video data. The video data may be originated from the game program stored in the RAM 93.

The IC card reader 62 reads out data stored in the IC card inserted into the card slot 176 to provide the read-out data to the main CPU 91. Also, the IC card reader 62 writes data received the main CPU 91 into the ID card.

The ticket printer 66 prints on a ticket the barcode containing information of the credit amount stored in the RAM 93, date and time, the identification number of the slot machine 1, and the like, in response to the control signal from the main CPU 91 to output the barcode imprinted ticket.

The key switch 67*s*, which is disposed behind the keypad 67, outputs a key detection signal to the main CPU 91 when the keypad 67 is pressed by the player.

The data display 68 displays information related the input through the keypad 67 in response to a control signal from the main CPU 91.

During the execution of the normal round and the free round, the slot machine 680 displays a variety of images and actions on the displays 20 and 70, embodiments of which is described in detail.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A gaming machine comprising:

a display device that includes a plurality of reels including a plurality of symbols thereon;

an input device configured to be operable with a setting screen displayed, a rendering effect activation being turned on and turned off through the setting screen; and a controller configured to:

determine whether the rendering effect activation is turned on or turned off;

determine a symbol arrangement of a game;

determine whether the symbol arrangement includes a predefined win;

execute the game by starting spinning the plurality of reels of the display device and by stopping the spinning of the plurality of reels to display the symbol arrangement on the display device; and perform a rendering effect on the spinning of the plurality of reels when it is determined that the rendering effect activation is turned on and only when the symbol arrangement includes the predefined win, wherein a duration of executing the game when the rendering effect activation is turned on is longer than a duration of executing the game when the rendering effect activation is turned off, wherein the rendering effect is not performed when it is determined that the rendering effect activation is turned off and the symbol arrangement includes the predefined win, wherein the controller is further configured to select one of a plurality of rendering patterns based on the symbol arrangement when it is determined that the rendering effect activation is turned on and the symbol arrangement includes the predefined win, and wherein the controller performs the rendering effect based on the selected one of the plurality of rendering patterns.

2. The gaming machine of claim 1, wherein the input device is configured to be operable with an administration key to have the setting screen.

3. The gaming machine of claim 2, wherein the game is neither being executed nor ready to be executed when the setting screen is displayed.

4. The gaming machine of claim 2, wherein the administration key comprises at least one of a physical key and a soft key.

5. The gaming machine of claim 1, wherein the controller is further configured to:

perform a payout based on the symbol arrangement.

6. The gaming machine of claim 1, wherein the rendering effect comprises at least one of rendering movement of the plurality of symbols, visual effect, and sound effect.

7. The gaming machine of claim 6, wherein the rendering movement comprises a long spin action.

8. A gaming method of a gaming machine including a display device and a controller configured to control the display device, the method comprising:

displaying, on the display device, a setting screen of a rendering effect activation to be turned on and turned off;

determining, by the controller, whether the rendering effect activation is turned on by an input device; and executing, by the controller, a game by starting spinning a plurality of reels and by stopping the spinning of the plurality of reels, wherein a rendering effect is performed on the spinning of the plurality of reels when it is determined that the rendering effect activation is turned on and only when a symbol arrangement includes a predefined win, wherein a duration of executing the game when the rendering effect activation is turned on is longer than a duration of executing the game when the rendering effect activation is turned off, wherein the rendering effect is not performed when it is determined that the rendering effect activation is turned off and the symbol arrangement includes the predefined win, wherein the executing a game comprises:

determining the symbol arrangement of the game;

selecting one of a plurality of rendering patterns based on the symbol arrangement when it is determined that the rendering effect activation is turned on and the symbol arrangement includes the predefined win; and spinning the plurality of reels based on the selected one of the plurality of rendering patterns.

9. The gaming method of claim 8, wherein the setting screen is displayed by an administration key.

10. The gaming method of claim 9, wherein the administration key comprises at least one of a physical key and a soft key.

11. The gaming method of claim 9, wherein the game is neither being executed nor ready to be executed when the setting screen is displayed.

12. The gaming method of claim 8, wherein the executing a game comprises:

performing a payout based on the symbol arrangement.

13. The gaming method of claim 8, wherein the rendering effect comprises at least one of rendering movement of the plurality of symbols, visual effect, and sound effect.

14. The gaming method of claim 13, wherein the rendering movement comprises a long spin action.

* * * * *